US005367308A

United States Patent [19]

Weber

[11] Patent Number: 5,367,308

[45] Date of Patent: Nov. 22, 1994

[54] THIN FILM RESONATING DEVICE

[75] Inventor: Robert J. Weber, Boone, Iowa

[73] Assignee: Iowa State University Research Foundation, Inc., Ames, Iowa

[21] Appl. No.: 891,436

[22] Filed: May 29, 1992

[51] Int. Cl.[5] ..... H01Q 1/38

[52] U.S. Cl. ..... 343/700 MS; 29/600

[58] Field of Search ..... 343/700 MS, 846, 778, 343/853; 29/600; H01Q 1/38

[56] References Cited

U.S. PATENT DOCUMENTS

| | | | |
|---|---|---|---|
| 4,366,484 | 12/1982 | Weiss et al. | 343/700 MS |
| 4,623,893 | 11/1986 | Sabban | 343/700 MS |
| 4,633,262 | 12/1986 | Traut | 343/700 MS |
| 4,642,508 | 2/1987 | Suzuki et al. | 310/321 |
| 4,851,855 | 7/1989 | Tsukamoto et al. | 343/873 |
| 5,034,753 | 7/1991 | Weber | 343/846 |
| 5,055,019 | 10/1991 | Zaghloul et al. | 343/700 MS |
| 5,182,564 | 1/1993 | Burkett et al. | 343/720 |

FOREIGN PATENT DOCUMENTS

| | | | |
|---|---|---|---|
| 0182203 | 9/1985 | Japan | 343/700 MS |
| 0099302 | 4/1989 | Japan | H01Q 1/38 |

OTHER PUBLICATIONS

G. Matthaei et al., excerpt from the book *Microwave Filters, Impedance-Matching Networks, and Coupling Structures*, Copyright 1964, pp. 430–434.

R. C. Hansen, excerpt from a manuscript, *IEEE Transactions on Aerospace and Electronic Systems* regarding Superconducting Antennas, Mar. 1990, pp. 345–355.

H. Satoh et al., Air-Gap Type Piezoelectric Composite Thin Film Resonator, 1985 IEEE, pp. 361–366.

An excerpt from *Monolithic Microwave Integrated Circuits: Technology & Design*, copyright 1989, pp. 163–164.

*Primary Examiner*—Donald Hajec
*Assistant Examiner*—Tan Ho
*Attorney, Agent, or Firm*—Leydig, Voit & Mayer, Ltd.

[57] ABSTRACT

A thin film resonator (TFR) antenna is disclosed which is characterized by substantially lower effective dielectric constant for the layer of dielectric material deposited between the ground metal layer and the top metal layer (transducer) of the TFR antenna. The dielectric constant is substantially lowered by forming an array of dielectric posts in the dielectric layer. The posts support the top metal layer of the TFR antenna. The interstices between the posts are occupied by air in the preferred embodiment. The lower effective dielectric value results in reduced ohmic losses which in turn leads to enhanced gain in the TFR antenna system.

21 Claims, 3 Drawing Sheets

THIN FILM RESONATING DEVICE

GRANT REFERENCE

The United States government has certain rights in this invention pursuant to contract No. ITA 87-02 between the U.S. Department of Commerce and Iowa State University.

FIELD OF THE INVENTION

This invention relates to thin film resonators and more particularly to thin film resonators configured to operate as antennas for transmitting and receiving very high frequency electromagnetic signals in the range from 100 MHz to several hundred GHz.

BACKGROUND OF THE INVENTION

It is known that one may construct one or more thin film resonators ("TFR's") on a semiconductor wafer to form microwave antenna devices. In general, TFR antennas comprise a metal ground plane, a dielectric layer, and a top metal layer. The top metal layer (or transducer), the interface to the microwave transmission medium, is coupled to signal receiving and transmitting circuitry in any of the many manners known to those of ordinary skill in the art. One such coupling technique, known as "acoustical coupling" is disclosed in Weber U.S. Pat. No. 5,034,753 wherein the transducer is coupled to the electrical portion of the antenna system by means of piezoelectric resonators.

A large observed characteristic impedance between the metal layers of a TFR antenna reduces ohmic losses in the antenna in relation to the radiation resistance for providing the signal thus improving the signal gain of the antenna system and the value of the figure of merit, Q. It is therefore desirable to increase the characteristic impedance between the metal layers of a TFR antenna.

There is a marked degradation in signal gain for TFR antennas built upon semiconductor material such as silicon as opposed to gallium arsenide. This is a result of the fact that gallium arsenide is a semi-insulator while silicon is a semiconductor. Therefore, the dielectric losses for TFR antennas built upon a silicon substrate are larger than the ohmic losses for TFR antennas built upon a gallium arsenide substrate. In practice the increased losses severely restrict the usefulness of silicon, the most popular substrate material in the industry today for building microelectronic circuits, for fabricating TFR antennas. In view of the cost and manufacturing advantages of using a silicon substrate instead of gallium arsenide, it is desirable to provide a means for overcoming the inherently higher losses and signal degradation resulting from fabricating TFR antennas upon a silicon wafer.

An air bridge design is known for limiting capacitance of a micro-strip transmission line by providing a thin line of support posts approximately 5 microns high and spaced approximately 75 microns apart upon which a 5 micron wide transmission line is deposited. The transmission lines are intended to conduct signals on a line, but are not intended to radiate energy into the air. Thus, the object of the known bridge design is to isolate signals transmitted linearly on separate lines.

SUMMARY OF THE INVENTION

In view of the foregoing, it is a general aim of the present invention to provide a microelectronic antenna which is miniature in size, can be configured utilizing standard microelectronic processing techniques, using conventional substrates, but which has superior properties as an antenna. In that respect, it is an object to provide such an antenna structure having a reasonably high Q to provide an antenna which is not only small in size but also has a reasonably high gain associated therewith.

It is a further aim of the present invention to reduce ohmic losses and to thereby provide high $Q_o$ values for an antenna system.

It is a specific object of the present invention to reduce the effective dielectric constant for the space between the ground plane and the top metal layer of a TFR.

It is a further specific object of the present invention to provide means of maintaining a space between the ground plane layer and the top metal layer of a TFR antenna while filling a substantial portion of the space with a non-rigid material having a relatively low dielectric constant.

According to one aspect of the invention, the known solid dielectric layer is replaced by a planar bridge structure for supporting the top metal layer. The bridge structure comprises a two dimensional array of spaced posts whose plan cross-section occupies only a very small fraction of the total area covered by the top metal layer. In a further aspect of the invention the interstices between the posts of the bridge layer are occupied by air or a suitable dielectric having a relatively low dielectric constant in comparison to silicon dioxide and other solid dielectric materials. The intersticial dielectric, in addition to having a relatively low dielectric constant, exhibits the additional physical characteristic of being incapable of supporting the top metal layer. This characteristic is typical of many gases, liquids, and other non-rigid materials which are incapable, without the additional bridging structures of the present invention, of supporting the top metal layer of the antenna system.

It is a feature of the invention that standard semiconductor type substrates can be utilized for forming an antenna using conventional microelectronic processing techniques while still providing a high Q antenna having high gain. In that respect, the invention utilizes an air bridge structure separating an antenna ground plane from the antenna radiating element, the air bridge serving to reduce ohmic losses and increase the signal gain of the antenna.

BRIEF DESCRIPTION OF THE DRAWINGS

The appended claims set forth the features of the present invention with particularity. The invention, together with its objects and advantages, may be best understood from the following detailed description taken in conjunction with the accompanying drawings of which:

DETAILED DESCRIPTION OF THE PREFERRED EMBODIMENTS

The present invention accomplishes the above and other objects through a TFR antenna structure constructed upon a wafer usually made from a suitable semiconductor, but may also be a semi-insulator or insulator (such as sapphire). The first layer, placed directly upon the semiconductor wafer surface, is a thin layer of metal or other conductive material providing an electrical ground for the antenna system. The second layer is a bridge layer which comprises an array of spaced posts composed of a suitably rigid dielectric material for providing a support structure for a third, top metal layer—which is also referred to herein as the transducer. The top metal layer is shaped and fed in a manner to radiate electromagnetic signals from predetermined portions of the top metal layer to the propagation medium which is typically air. The top metal layer is also shaped and coupled to the antenna system to receive electromagnetic signals from the propagation medium.

The present invention can best be understood when viewed in conjunction with the basic equations and their explanations discussed hereinafter.

Figure 5:
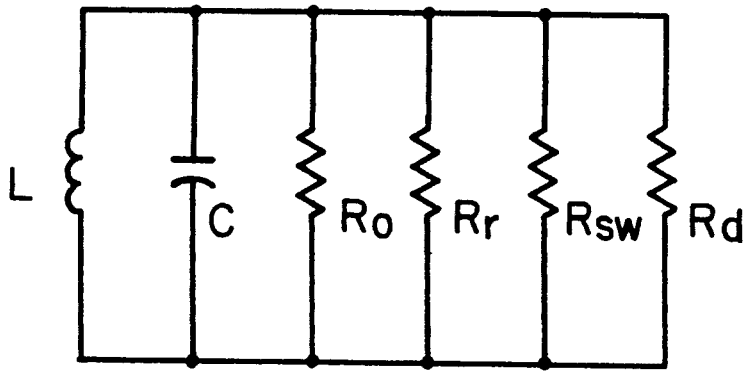
FIG. 5 is an RLC model of a TFR antenna at resonance.

For a parallel type of resonance, the driving point immitance of the radiating resonator can be characterized around the resonant frequency $\omega_o$ by a parallel RLC circuit which is schematically illustrated in FIG. 5, and where C and L are characterized by Equations 1 and 2 below. Series type of resonators are described by the dual equations in circuit theory. This specification uses the parallel description, but the dual series description could also be used for series type resonators.

$$C = \frac{1}{2} \left. \frac{dB}{d\omega} \right|_{\omega=\omega_o} \qquad \text{Equation 1}$$

$$L = \frac{1}{\omega_o^2 C} \qquad \text{Equation 2}$$

Where:

B=Driving point susceptance $R_o$=Resistance due to ohmic loss $R_r$=Resistance due to radiation (of electromagnetic energy)

$R_{sw}$=Resistance due to energy dissipated in surface waves $R_d$=Resistance due to dielectric losses The figure of merit, Q, is characterized by the following Equation 3.

$$Q = \frac{\omega_o C}{G_T} \qquad \text{Equation 3}$$

Where:

$$G_T = \frac{1}{R_o} + \frac{1}{R_r} + \frac{1}{R_{sw}} + \frac{1}{R_d}; \qquad \text{Equation 4}$$

Equation 5

$Q_o=\omega_o CR_o$;

Equation 6

$Q_r=\omega_o CR_r$;

Equation 7

$Q_{sw}=\omega_o CR_{sw}$;

and

Equation 8

$Q_d=\omega_o CR_d$.

It is desired that the power dissipated in $R_r$ be as large as possible. This requires that $R_r$ be made as small as possible in relation to the other resistances and in effect raise $Q_o$ in relation to $Q_r$. However, for a thin film conductor on a semiconductor wafer with 0.5 μm to 1 μm dielectric layer such as silicon dioxide, $R_o$ is smaller than $R_r$ for typical resonators at 1 GHz. Raising the characteristic impedance of the resonator will raise the impedance level of the driving point impedance and also increase the ratio of $R_o$ to $R_r$. This increases the portion of power radiated in comparison to the power dissipated in $R_o$, the resistance which characterizes ohmic loss. This is due in part to increasing the value of the electric di-pole on the end of the resonator as the characteristic impedance of the resonator is increased.

Therefore, it is desirable to increase the characteristic impedance of the resonator. A secondary effect will be an increase in the values of $R_{sw}$ and $R_d$ if appropriate values of dielectric are used. $R_{sw}$ and $R_d$ will increase to very large values if the dielectric used is air.

The various layers are generally formed in the following manner. First, the ground plane metal layer is deposited in the desired pattern upon a semiconductor substrate by electron beam evaporation or any other suitable metal deposition method known to those skilled in the art. The ground plane metal layer (also referred to as the thin film conductive layer) is patterned and etched if necessary in any well known manner. This first layer functions as the ground plane for antennas formed upon the substrate. It should be noted that suitable superconductive materials may also be used.

Second, a layer of dielectric material from which the bridge posts will be formed is deposited upon the ground plane layer by, for example, sputtering or plasma enhanced chemical vapor deposition. Third, a layer of photoresist is deposited upon the layer of dielectric material. Fourth, the photoresist layer is selectively developed according to the bridge post array pattern—resembling a bed of nails—in order to form the bridge layer of the TFR. Fifth, the dielectric material is then etched by means of a reactive ion etcher in a manner known to those skilled in the art. After executing the fifth step, the bridge layer contains an array of spaced dielectric posts projecting above the ground plane layer.

Sixth, a layer of photoresist is deposited within the bridge layer at a thickness equal to the height of the dielectric posts. Care is taken to ensure that the tops of the dielectric posts are not covered by the photoresist. This is accomplished by using positive developing photoresist. Thereafter, the tops of the posts are exposed to ultraviolet light. The exposed portion is then developed, thus ensuring that the tops of the dielectric posts are exposed.

Seventh, the top metal layer is deposited by electron beam evaporation of a suitable metal type or by various means for depositing superconductor for receiving and transmitting high frequency electromagnetic signals in the range from 100 MHz to several hundred GHz. Eighth, a layer of photoresist is placed over the top metal layer, and selectively developed in a manner known to those skilled in the art.

Ninth, the top metal layer is etched so that the top metal layer exists only in desired areas of the semiconductor wafer. The top metal layer is shaped and connected to the other antenna components in a manner such that the top metal layer functions as a radiating and receiving element for the antenna system operating in the range from 100 MHz to several hundred GHz.

The final step is to dissolve the photoresist deposited in the spaces between the posts in the bridge layer during the sixth step. This is accomplished by soaking the semiconductor wafer upon which the TFR is constructed in a solvent for several hours to ensure that all the photoresist (also referred to herein as sacrificial material) is removed from the bridge layer so that the only solid material in the bridge layer is the dielectric forming the two-dimensional array of bridge posts. Thereafter, the semiconductor wafer containing the one or more TFR antenna systems is allowed to slowly dry to prevent harm to the top metal layer and the other components of the TFR antenna systems.

Figure 1:
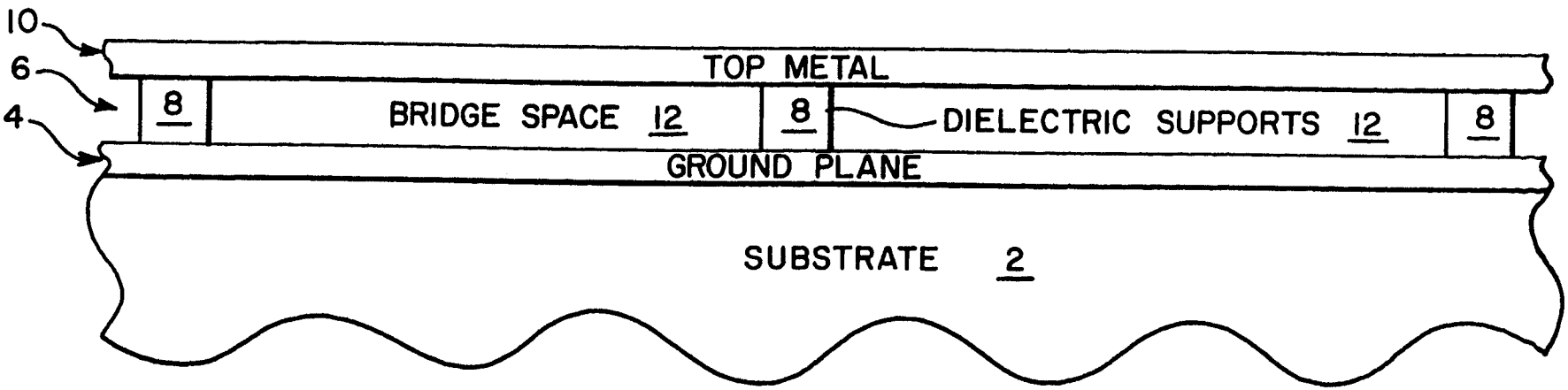
FIG. 1 is a diagram schematically illustrating a cross-sectional view of an embodiment of the antenna element exemplifying the present invention.

Having described the method for fabricating the TFR antenna systems, attention is now directed toward a detailed description of the structure of the TFR antenna which is the subject of the present invention. Turning now to FIG. 1, a schematic diagram is shown in cross-section to reveal the general physical features and relationship of the various layers of the TFR antenna described above. In order to facilitate identification of the various structures of the TFR antenna of the present invention, the various features are not drawn to scale.

The substrate layer 2 of the TFR antenna consists of any suitable semiconductor, semi-insulator or insulator. Present preferred substrate materials are gallium arsenide and silicon. Other suitable materials for use as the substrate material would be known to those of ordinary skill in the art.

The ground plane layer 4 of the TFR antenna consists of a 0.5 to 1.0 micron thick layer of electron beam evaporated metal. Presently, the ground plane metal layer 4 is either aluminum or silicon aluminum but could also be copper. However, any of several types of highly conductive materials, including super-conducting materials, may be used for the ground plane layer. The ground plane layer 4 during operation of the TFR antenna is connected to an electrical ground in a manner as would be known to those of ordinary skill in the art.

The bridge layer 6 comprises a two-dimensional array of silicon dioxide posts 8 (also referred to as supports). However, the posts 8 may be any suitably rigid dielectric material capable of maintaining a predetermined spacing between the ground plane layer 4 and a top metal layer 10. Examples of alternative materials are: silicon monoxide, silicon oxynitride, silicon nitride, zinc oxide, aluminum oxide, aluminum nitride. Additional alternative dielectric materials would be known by those skilled in the art.

Figure 2:
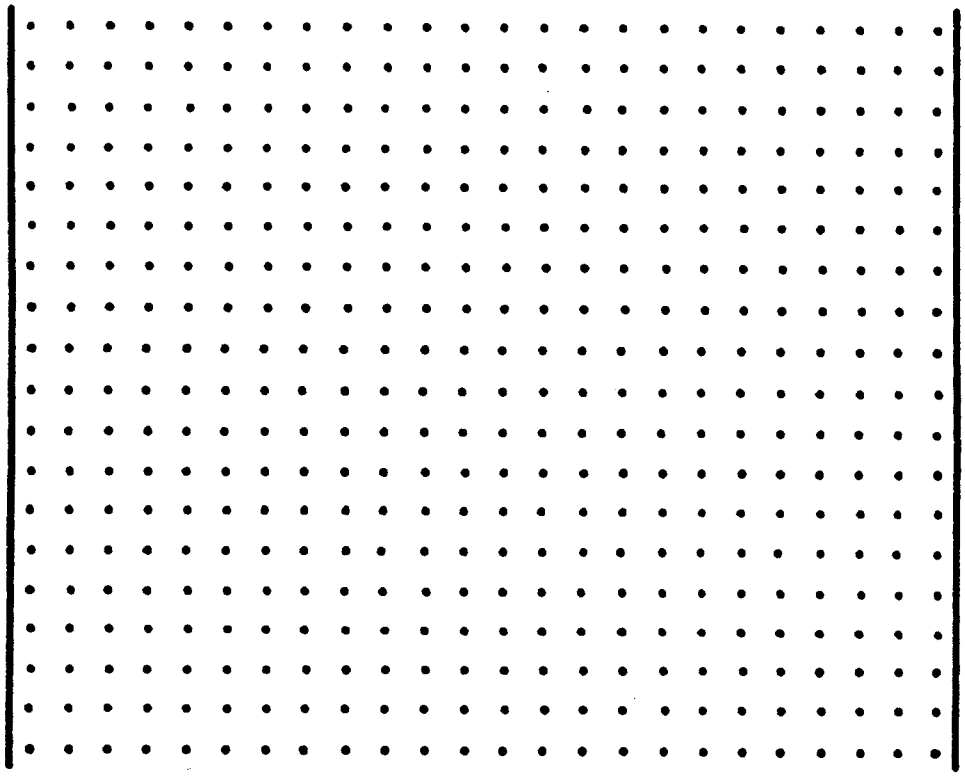
FIG. 2 is a diagram schematically showing a plan view of a section of the bridge layer of the TFR antenna system.

In the preferred embodiment of the invention, the top surface area of each post 8 is approximately 10 microns by 10 microns, and each post 8 is approximately 5 microns in height. However, other shapes and dimensions for the dielectric posts 8 would be known to those of ordinary skill in the art in view of the teachings contained herein. The evenly spaced posts 8 arranged in a two-dimensional array resembling the bed of nails pattern shown in FIG. 2, occupy approximately 4% of the total surface area of the bridge layer 6. However, other non-uniform post spacing arrangements would be known to those skilled in the art in view of the description of the invention herein.

A reduction in the post dimensions to 5 microns by 5 microns is presently contemplated in order to reduce the percentage of the surface area of the bridge layer 6 occupied by the posts 8 to 1%. In this embodiment, the surface area of the posts 8 is decreased substantially, but the number and positioning of the posts 8 remains unchanged. Though it is desired to minimize the surface area occupied by the dielectric posts 8, the dimensions of the posts 8 are limited by the need to maintain the structural stability of the posts 8 and the precision of microelectronic lithography equipment, materials, and techniques.

The distance between the ground plane layer 4 and the top metal layer 10 (i.e. the thickness of the bridge layer 6) is about 5 microns. The minimum distance is constrained by the need to maintain a sufficiently high impedance between the ground plane layer 4 and the top metal layer 10 in order to limit ohmic losses. The maximum width is constrained by the physical limitations of the posts 8 which may break or separate from the metal layers 4 and 10 under lateral strain if the bridge layer 6 is too thick. Typically the width of the bridge layer 6 is between 3 and 5 microns.

The interstices 12, or portions of the bridge layer 6 not occupied by the posts 8, are preferably occupied by air which is a good dielectric. However, the interstices 12 may be occupied by any good dielectric which, by itself could not maintain the spacing between the ground plane layer 4 and the top metal layer 10 due to the insufficient rigidity of the particular dielectric. A number of liquids and gases having dielectric constants smaller than the dielectric constant of silicon dioxide would fit within this category.

The bridge design provides the necessary support features of previously known, solid, dielectric layers. However, the bridge layer 6 of the present invention provides the advantageous feature of lowering the effective dielectric constant of the dielectric layer. This in turn results in a superior Q value for a TFR antenna. The bridge design of the present invention increases the effective parallel ohmic resistance and thus lowers the ohmic losses associated with a TFR antenna and thereby increases the gain of the TFR antenna. The top metal layer 10 consists of either electron beam evaporated aluminum or silicon aluminum but may also be copper 0.5 to 1.0 microns thick. However, the top metal layer 10 which operates as the transducer of signals between the propagation medium and a receiver or transmitter may be made of any microwave antenna grade metal or super-conducting material suitably durable to withstand puncturing by the posts 8 or damage from other sources which would be known to those of ordinary skill in the art.

Though one of ordinary skill in the art would appreciate that a greater thickness (up to one skin thickness) would be desirable, the great time period for depositing a thick layer of metal by electron beam evaporation and known detrimental effects weigh heavily against depositing a layer of metal greater than 1 micron thick.

The top metal layer 10, also referred to as the transducer, is shaped and coupled to the other components of the antenna system to provide the interface between the propagation medium and electronic transmitting and receiving circuitry for high frequency electromagnetic signals (generally 100 MHz to several hundred GHz).

Though it is preferable to have a single, continuous sheet of metal for the microwave antenna, one may pattern a plurality of micro holes in the top metal layer 10 in order to expedite the final step of the TFR fabrication process of dissolving the photoresist deposited between the posts 8 during the sixth step of the process described above.

During operation of the TFR antenna, the top metal layer is coupled to an excitation source and/or signal receiver in a manner as would be known to those of ordinary skill in the art. The antenna will typically operate in the range of frequencies from 100 Mhz to several hundred GHz.

Figure 3:
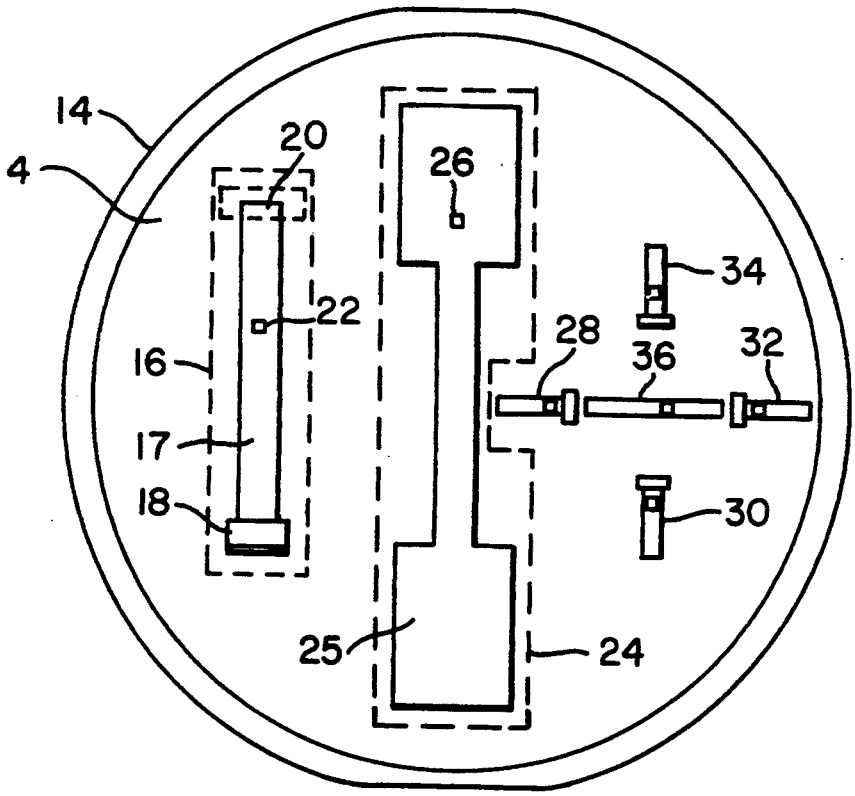
FIG. 3 is a diagram schematically showing a plan view of three exemplary configurations of TFR antenna's.

Turning now to FIG. 3, a set of three TFR antennas utilizing the present invention are schematically illustrated. In each case, a layer containing an array of dielectric posts 8 (not shown) separates the ground plane metal layer 4 from the top metal layer for each antenna. On the left portion of the semiconductor wafer 14 having a ground metal plane 4 extending across virtually the entire surface of the wafer 14, a quarter wave resonator mono-pole antenna 16 is shown. The top metal layer 17 of the quarter wave resonator 16 is shaped, grounded at the bottom end 18, and coupled to an excitation and receiving source so that a large majority of the radiation is emitted from the top end 20. Point 22 represents the launch for the antenna which may receive electromagnetic energy acoustically transduced or electromagnetic energy transferred by means commonly used in the art.

Next a foreshortened half-wave resonator 24 is illustrated. The afore-described launch point 26 is positioned at the top lobe. The particular configuration and connection of the foreshortened resonator 24 causes the top metal layer 25 to radiate energy from both the top and bottom ends. The dumbbell shape of the top metal allows shortening of the length of the antenna 24 so that the antenna 24 fits upon the wafer 14.

Finally, a plurality of antennas are arranged on the right side of the wafer 14 in a phased array configuration. Four mono-pole antennas 28, 30, 32, and 34, shaped and grounded in a manner similar to antenna 16 described above to radiate from only one end, are situated around a di-pole antenna 36 which radiates electromagnetic energy from both ends. The arrangement of antennas 28, 30, 32, 34 and 36 results in a null steering or pointing phased array antenna.

Figure 4:
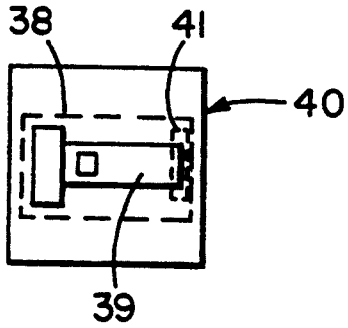
FIG. 4 is a diagram schematically showing a plan view of an X-band TFR antenna placed upon a single semiconductor chip.

Turning now to FIG. 4, an X-band antenna 38 is situated upon the underside of a 0.25 by 0.25 inch semiconductor chip 40. The top metal layer 39 is shaped and coupled to the other antenna components to radiate energy from end 41.

It will be appreciated by those skilled in the art that modifications to the foregoing preferred embodiments may be made in various aspects. The present invention is set forth with particularity in the appended claims. It is deemed that the spirit and scope of that invention encompasses such modifications and alterations to the preferred embodiment, as would be apparent to one of ordinary skill in the art and familiar with the teachings of the present application.

What is claimed is:

1. A microelectronic antenna formed on a substrate of the type used for semiconductor devices, and adapted for operation at very high frequencies, the antenna comprising, in combination:

a supporting substrate of the type used to support microelectronic circuits, a first thin film conductive layer deposited on the substrate and connected to serve as a ground plane for the antenna, an array of dielectric posts projecting from the ground plane on the order of five microns, a top thin film conductive layer supported by said posts, the top thin film conductive layer being fed as the radiating element of the antenna, and the array of dielectric posts and the first and top thin film conductive layers forming a bridge structure separating said first and top thin film conductive layers where the majority of a space between said first and top thin film conductive layers defined by the bridge structure is occupied by air, the minority of the area being occupied by the dielectric material of the posts, thereby to reduce the ohmic losses in the antenna structure and enhance the signal gain thereof.

2. The microelectronic antenna of claim 1 wherein said top thin film conductive layer is rectangularly shaped and grounded on a first end so that said top thin film conductive layer emits electromagnetic energy almost entirely from a second, opposing, end.

3. The microelectronic antenna of claim 2 wherein said microelectronic antenna is positioned on a wafer and coupled in cooperative configuration with a plurality of other antennas to form a phased array antenna system.

4. The microelectronic antenna of claim 1 wherein said top thin film conductive layer is dumbbell shaped and connected to an energizing source in a manner such that the top thin film conductive layer emits electromagnetic energy almost entirely from a first and a second opposing end.

5. The microelectronic antenna of claim 1 wherein said top thin film conductive layer is acoustically coupled to an excitation source.

6. The microelectronic antenna of claim 1 wherein said microelectronic antenna is positioned on a wafer and coupled in cooperative configuration with a set of antennas to form a phased array antenna system.

7. The microelectronic antenna of claim 1 wherein the posts cover no more than about 4% of the surface area of the top thin film conductive layer.

8. A method of forming a microelectronic antenna comprising the steps of:

depositing a thin film conductive layer on a substrate of the type used to support microelectronic circuits, and providing a connection point to the thin film layer to cause said thin film conductive layer to function as a ground plane for an antenna structure, forming a dielectric layer having a thickness on the order of 5 microns on the thin film conductive layer, patterning the dielectric layer to form an array of posts projecting from the thin film conductive layer, filling the area intermediate the posts with a sacrificial material to form a planar surface parallel with and disposed above the surface of the thin film conductive layer, depositing a second conductive layer on said planar surface, providing a coupling to the second conductive layer to cause said second conductive layer to serve as a radiating and receiving element for the antenna, removing the sacrificial material intermediate the posts after said step of depositing a second conductive layer thereby providing an air bridge structure in which the second conductive layer is supported above the ground plane by said posts while being separated therefrom primarily by an air dielectric.

9. The method of claim 8 wherein said patterning step comprises removing dielectric material so that the remaining posts occupy no more than 4% of the surface area of the thin film conductive layer.

10. A thin film resonator (TFR) device for high frequency operation constructed upon a semiconductor substrate comprising:

a semiconductor substrate, a ground plane layer deposited on the semiconductor substrate, a top conductive layer extending in two dimensions for radiating and receiving electromagnetic signals from a propagation medium, and bridge means projecting from said ground plane layer and supporting said top conductive layer, said bridge means having a height on the order of 5 microns to form a volume between said ground plane layer and said top conductive layer having a relatively low dielectric value, thereby reducing ohmic losses for the TFR.

11. The TFR device of claim 10 wherein said bridge means comprises a plurality of spaced posts composed of a dielectric material arranged over a surface area of the ground plane layer, said posts supporting said top conductive layer.

12. The TFR device of claim 11 wherein said plurality of posts are arranged in a two dimensional array.

13. The TFR device of claim 11 wherein said posts are 5 microns tall.

14. The TFR device of claim 13 wherein each of said posts has a top surface area of approximately 10 microns by 10 microns.

15. The TFR device of claim 11 wherein the combined top surface area of said plurality of spaced posts covers less than 4 percent of the surface area of said top conductive layer.

16. The TFR structure of claim 11 wherein the ratio of the height of a one of said plurality of posts to the width of said one is approximately 1 to 2.

17. The TFR structure of claim 11 wherein each of said posts has a top surface area of approximately 5 microns by 5 microns.

18. The TFR structure of claim 17 wherein the combined top surface area of said plurality of spaced posts covers about 1 percent of the surface area of said top conductive layer.

19. The TFR structure of claim 11 wherein the ratio of the height of a one of said plurality of posts to the width of said one is approximately 1 to 1.

20. The TFR structure of claim 11 wherein the space between said posts in said volume between said ground plane layer and said top metal layer comprises air.

21. The microelectronic antenna of claim 10 wherein said top thin film conductive layer is acoustically coupled to an excitation source.

* * * * *